US005421665A

United States Patent [19]

Strassberg

[11] Patent Number: 5,421,665

[45] Date of Patent: Jun. 6, 1995

[54] FLIP CHART CARD FILE

[76] Inventor: Gerson Strassberg, 18 Engineers Rd., Roslyn Harbor, N.Y. 11576

[21] Appl. No.: 112,889

[22] Filed: Aug. 27, 1993

[51] Int. Cl.[6] ..... B42F 17/00

[52] U.S. Cl. ..... 402/79; 40/124.2; 40/405; 40/537; 206/44 B; 281/38; 402/80 R

[58] Field of Search ..... 402/79, 80 R, 500, 80 P; 281/31, 38; 40/159, 537, 405, 124.2; 206/44 B, 45.31

[56] References Cited

U.S. PATENT DOCUMENTS

| | | | |
|---|---|---|---|
| 1,596,661 | 8/1926 | Hutchings | 40/124.2 |
| 2,122,956 | 7/1938 | Salley . | |
| 2,177,071 | 10/1939 | Klein et al. . | |
| 2,755,576 | 7/1956 | Golden | 281/15.1 X |
| 2,871,153 | 1/1959 | Copen | 40/159 X |
| 2,888,932 | 6/1959 | Freiberg | 281/5 X |
| 3,292,632 | 12/1966 | Hopen . | |
| 3,555,713 | 1/1971 | Leinbach . | |
| 3,816,948 | 6/1974 | Mooney et al. | 40/124.2 X |
| 4,365,433 | 12/1982 | Buell . | |
| 4,560,068 | 12/1985 | Membrino | 383/38 X |
| 4,614,450 | 9/1986 | Neiman . | |
| 4,704,042 | 11/1987 | Eisen et al. . | |
| 4,848,576 | 7/1989 | Stemmer, Jr. . | |
| 5,096,752 | 3/1992 | Wagner . | |

FOREIGN PATENT DOCUMENTS

| | | | |
|---|---|---|---|
| 977148 | 3/1951 | France | 281/5 |
| 1436813 | 1/1969 | Germany | 281/5 |

OTHER PUBLICATIONS

The 1988 Jacobs Gardner Office Products Catalog, pp. 244–245.

The 1989 Miller's Office Products Catalog, pp. 254–255.

*Primary Examiner*—Frances Han

*Attorney, Agent, or Firm*—Collard & Roe

[57] ABSTRACT

A device for storing and providing ready access to cards having a substantially rigid base member with a continuous rectangular wave-shaped slit therein. The slit forms a first set of tabs and a second set of tabs. The device further includes translucent card holders mounted on the base member for storing the cards. Each card holder has complementary slots for receiving the first set of tabs. The second set of tabs retain each card holder in place to prevent disengagement from the first set of tabs. Each card holder can be flipped to provide access to other card holders.

16 Claims, 5 Drawing Sheets

FLIP CHART CARD FILE

BACKGROUND OF THE INVENTION

1. Field of the Invention

The invention relates to a flip chart card file for visibly storing numerous cards adjacent to each other. More specifically, it relates to a flip chart card file in which the upper card files can be flipped open to reveal the cards in a lower card file.

2. The Prior Art

Filing systems are known where individual card holders can be attached to or removed from a base unit. For example, the U.S. Patent to Salley, No. 2,122,956, the U.S. Patent to Klein et al, No. 2,177,071, and the U.S. Patent to Hopen, No. 3,292,632, disclose various recording and filing systems. U.S. Pat. No. 2,122,956 discloses a filing system where tabs of the base unit seat within cut outs on the card holders. U.S. Pat. Nos. 2,177,071 and 3,292,632 disclose systems in which the individual card holders are provided with tabs which are inserted into cut outs in the base. These patents all have certain disadvantages in that the individual card holders are not securely mounted to the bases and can therefore become accidentally separated from the bases.

More recently, card files have been manufactured in which the individual card holders, made from a translucent vinyl material, are permanently welded to the bases. Manufacturing these types of card files can be expensive, particularly if many card holders are attached to each base.

SUMMARY OF THE INVENTION

It is therefore an object of the present invention to overcome the drawbacks of the prior art and to provide a flip chart card file that can be inexpensively and simply manufactured.

It is a further object of the present invention to provide a flip chart card file in which the card holders are securely mounted to the base.

These and other related objects are achieved according to the invention by a device for storing and providing ready access to a plurality of items. The device includes a base member having a plurality of slits therein. Each slit forms a first set of tabs and a second set of tabs. The device further includes an item holder mounted on the base member for storing the items. The first and second set of tabs work in conjunction with each other to mount the item holder, retain it in position and permit it to be flipped.

BRIEF DESCRIPTION OF THE DRAWINGS

Other objects and features of the present invention will become apparent from the following detailed description considered in connection with the accompanying drawings that disclose two embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
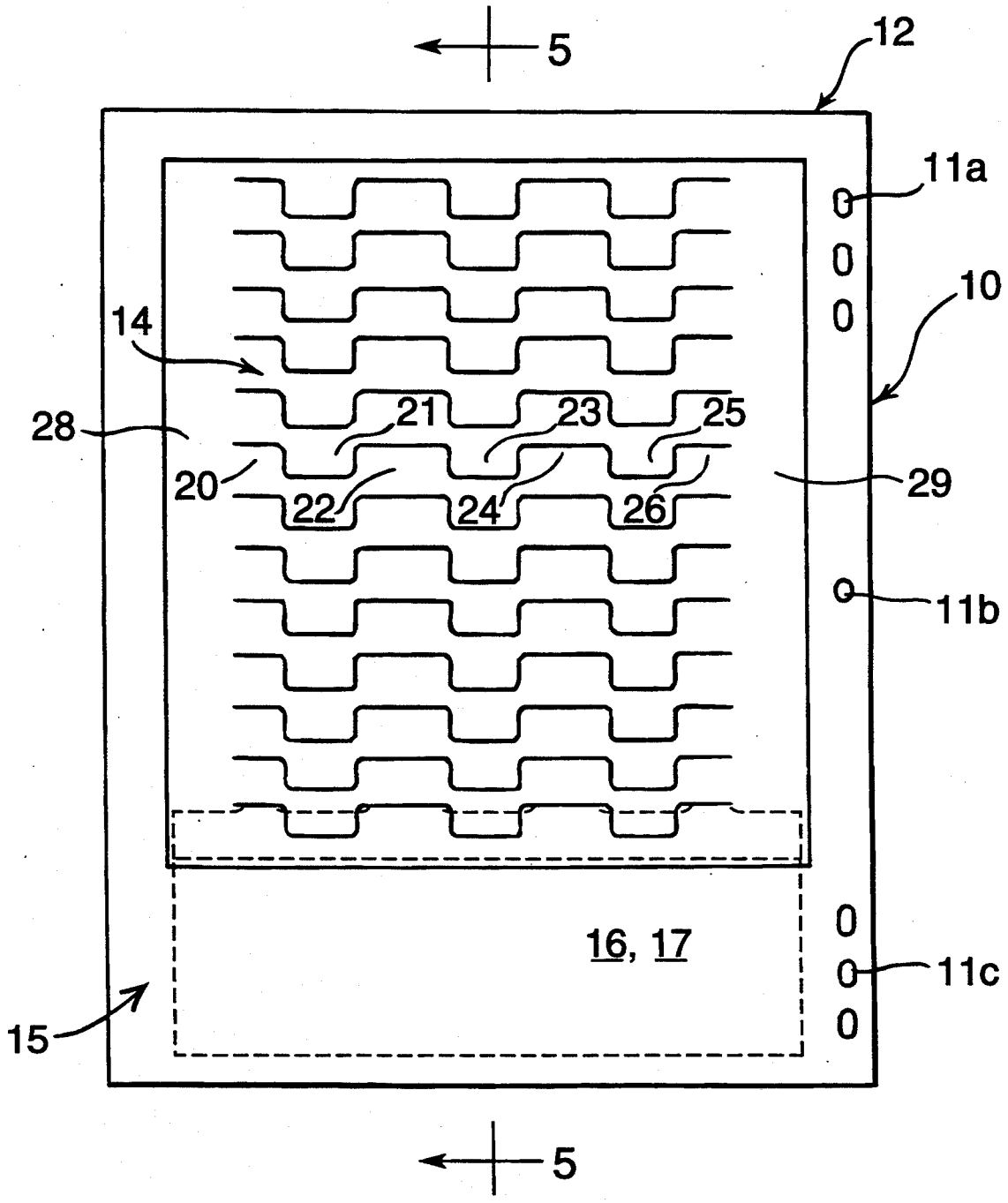
FIG. 1 is a front, side elevational view of the flat base with a card holder in phantom line according to the invention.

Referring now in detail to the drawings and, in particular, FIG. 1, there is shown a flat base 10 which optionally includes holes 11*a*, 11*b*, and 11*c* along a margin 12. Holes 11*a*, 11*b* and 11*c* can be spaced along margin 12 to allow flat base 10 to be placed into a three ring binder or other organizer with rings. Flat base 10 is made from a substantially rigid material, for example, vinyl or polyvinyl chloride. Base 10 is provided with numerous parallel slits 14 that extend continuously across the central part of the sheet. Slits 14 do not extend to a lower section 15 of the sheet. Each individual slit is in the shape of a continuous rectangular or square wave and has upwardly extending tabs or teeth 20, 22, 24 and 26 which alternate with downwardly extending tabs or teeth 21, 23 and 25. Each tab has a free end and an attached end. The free ends of the downwardly extending tabs are adjacent to the attached ends of the upwardly extending tabs. The free ends of the upwardly extending tabs are adjacent to the attached ends of the downwardly extending tabs. On either side of slits 14 is a region 28 and 29 shaped as a narrow strip. A card holder 16 or 17, which will be described further below, is shown in phantom on the lower part of base 10. One card holder 16 or 17 would be attached to each slit 14.

Figure 2:
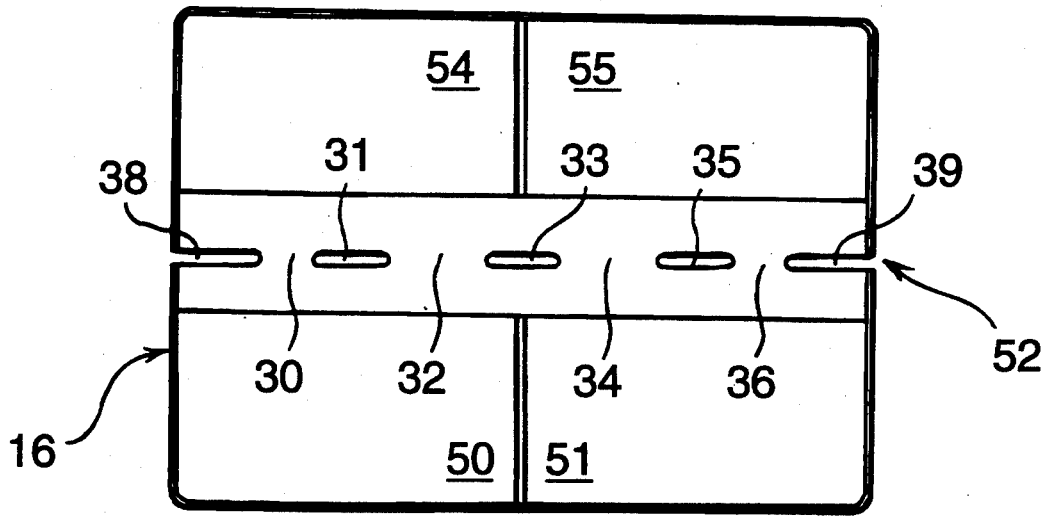
FIG. 2 is a top plan view of a card holder for mounting on the base.
Figure 3:
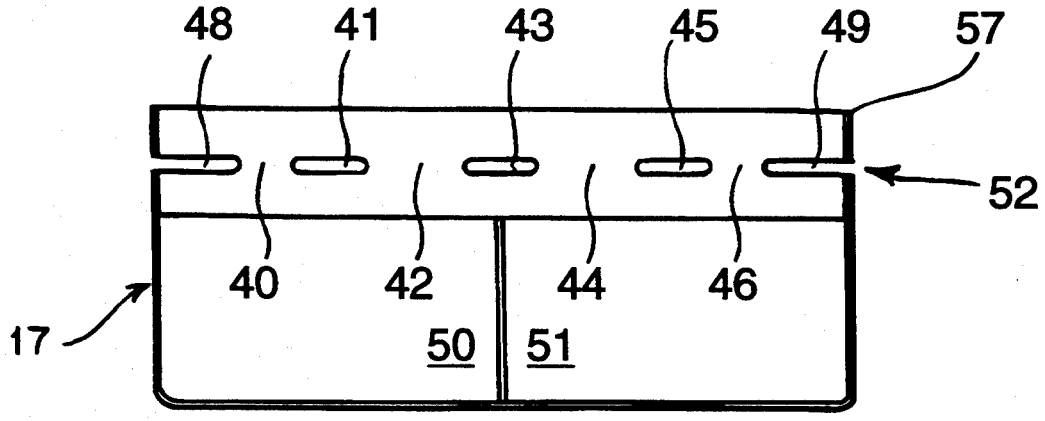
FIG. 3 is a top plan view of an alternate embodiment of the card holder.

As can be seen in FIGS. 2 and 3, there is shown a two-sided item or card holder 16 and a single-sided item or card holder 17. Both card holders 16 and 17 have a first set of pockets 50 and 51 for receiving cards or other notes or written material. Card holders 16 and 17 may optionally have one pocket or more than two pockets. Card holders 16 and 17 can be made from any substantially flexible translucent or transparent material, for example, vinyl or polyvinyl chloride. Two cards can be placed into each pocket 50 or 51 with the backs of the card facing each other so that the opposite facing card are visible through the front and back of the pocket. Card holders 16 and 17 also both have an attachment region 52 which includes a series of aligned central slots 31, 33, 35 and 41, 43, 45, which are arranged end-to-end. The attachment regions also include a pair of aligned end slots 38, 39, and 48, 49, which are arranged end-to-end with the central slots. The central slots and end slots are all in spaced co-linear relation to each other.

Between the central slots and the end slots are several panels 30, 32, 34, 36 and 40, 42, 44, 46. Card holder 16 further includes two additional pockets 54 and 55, which are symmetrical with pockets 50, 51, while card holder 17 terminates at an edge 57 which borders attachment region 52. Pockets 50, 51, 54 and 55 are formed by folding and welding a single sheet of vinyl or by placing two sheets of vinyl together and welding the three closed sides of the pockets. Card holder 16 forms a symmetrical configuration about the axis of the slots or about a line parallel and intermediate the slots.

Figure 4:
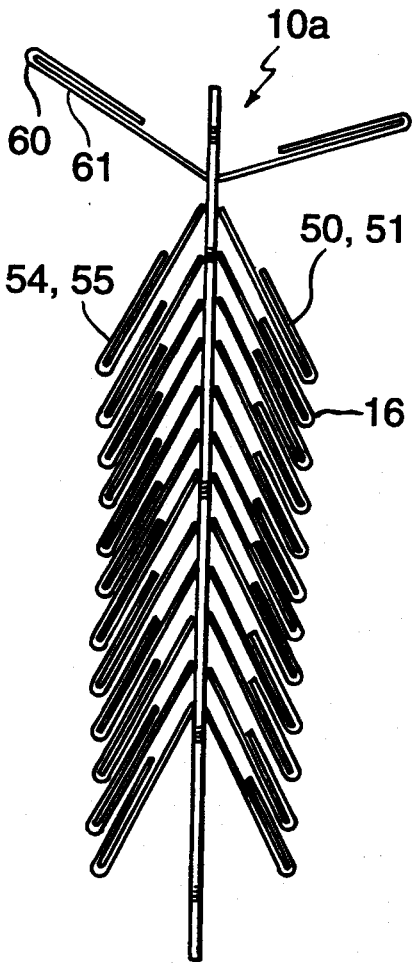
FIG. 4 is a side elevational view of the base and mounted card holders from FIG. 2.
Figure 5:
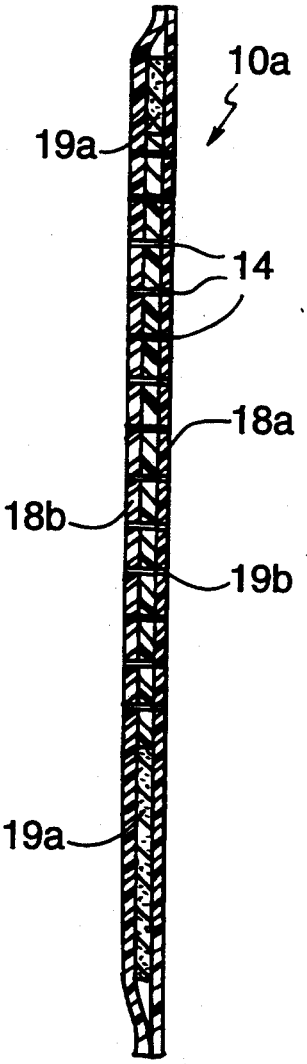
FIG. 5 is a cross-sectional view taken along the line 5—5 from FIG. 1.
Figure 8:
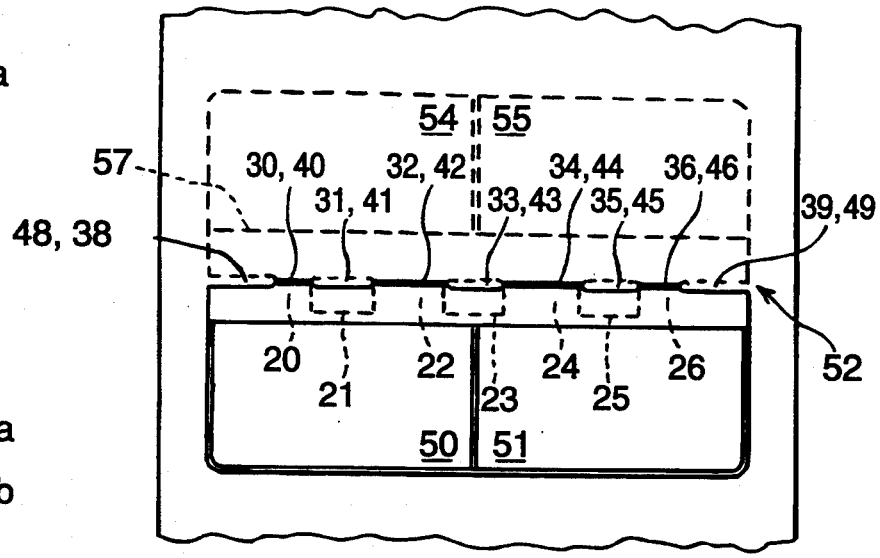
FIG. 8 is a schematic diagram showing how each card holder is mounted to the base.

FIG. 4 shows one embodiment of the invention with FIG. 5 showing an enlarged cross-sectional view thereof. Base 10 is made of outer layers 18*a* and 18*b*. Between layers 18*a* and 18*b* is a frame member 19*a* and a middle layer 19*b*. Base 10*a* is constructed as follows. Outer layer 18*a* is laid flat and covered with frame member 19*a* that extends around the periphery of outer layer 18*a*, for example, in the regions of lower section 15 and margin 12. Middle layer 19*b* is placed within frame member 19*a*. Outer layer 18*b* is then placed over frame member 19*a* and middle layer 19*b*. Frame member 19*a* is made from cardboard, for example, to provide structural rigidity to base 10*a* while the outer layers are all made from vinyl, for example. The outer edges of base 10*a* are then welded together to seal around frame member 19*a*. Slits 14 are welded contemporaneously by heating layers 18*a*, 18*b* and 19*b* within the confines of frame member 19*a*. Each slit 14 passes completely through base 10*a* as can be seen in FIG. 5. Card holder 16 is mounted on flat base 10 by placing pockets 54 and 55 through a slit 14 so that pockets 50 and 51 remain on one side of base 10*a* while pockets 54 and 55 extend from the opposite side of base 10*a*, as can be seen in FIG. 4. As can be seen in FIG. 8, downwardly extending tabs 21, 23 and 25 pass through slots 31, 33 and 35. Card holder 16 is slid upward toward the attached end of downwardly extending tabs 21, 22 and 23 so that panels 30, 32, 34 and 36 are located above the free ends of upwardly extending tabs 20, 22, 24 and 26. End slots 38 and 39 overlap regions 28 and 29. The free ends of upwardly extending tabs 20, 22, 24 and 26 lock card holder 16 in place and prevent it from sliding down, toward the free end of the tabs 21, 23, 25, and out of engagement with downwardly extending tabs 21, 23 and 25. As a result of this lock, the card holders, as can be seen in FIG. 4, can be flipped upwardly into position 60 so that the cards facing side 61 can be viewed as well as the cards located in the lower card holders.

Figure 7:
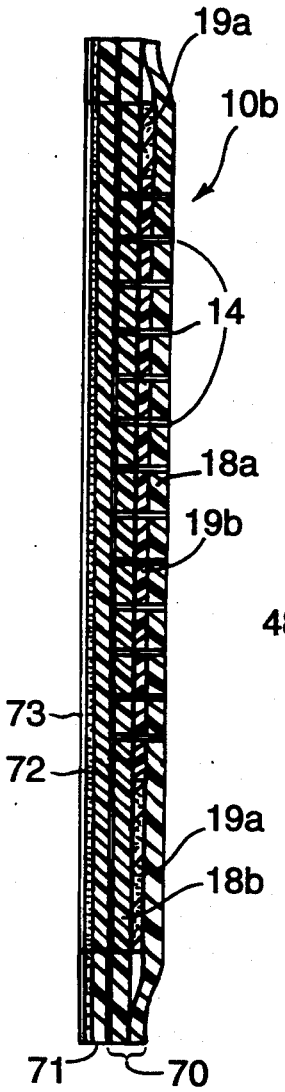
FIG. 7 is a cross-sectional view of the alternate embodiment from FIG. 6.

In an alternate embodiment, as shown in FIG. 7, base 10b is provided with slits 14 that pass entirely through first layer 70. A backing layer 71 is located behind first layer 70. An adhesive layer 72 is then mounted to the rear of second layer 71 and a covering layer 73 covers adhesive layer 72 for shipping and handling. Card holder 17 is mounted to base 10*b* by placing edge 57 through a slit 14 and folding it down so that edge 57 resides between first layer 70 and second layer 71 behind the upper edges of pockets 50 and 51. Base 10*b* is formed from outer layers 18*a* and 18*b*, frame member 19*a* and middle layer 19*b* similar to base 10*a*. Base 10*b* is supported by the structural rigidity of frame member 19*a* with slits 14 located within frame member 19*a*.

Figure 6:
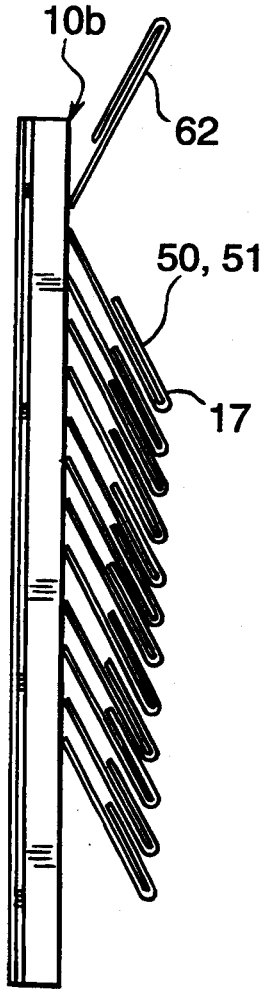
FIG. 6 is a side elevational view of an alternate embodiment of the flat base with mounted card holders from FIG. 3.

Downwardly extending tabs 21, 23 and 25 pass through slots 41, 43 and 45 as can be seen in FIG. 8. Pockets 50 and 51 extend from one side of base 10b, as can be seen in FIG. 6. The free ends of upwardly extending tabs 20, 22, 24 and 26 lock against regions 40, 42, 44 and 46 so that card holder 17 can be flipped upward so that the cards facing side 62 can be viewed as well as the lower tiered cards. Protective layer 73, as shown in FIG. 7, can then be peeled off and base 10*b* can then be mounted on a wall or other surface with adhesive layer 72. Optionally, card holder 16 and/or 17 can have slots which allow it to be slid downward onto the upwardly extending tabs, with the downwardly extending tabs resting against the panels to lock the card holder in place.

Figure 12:
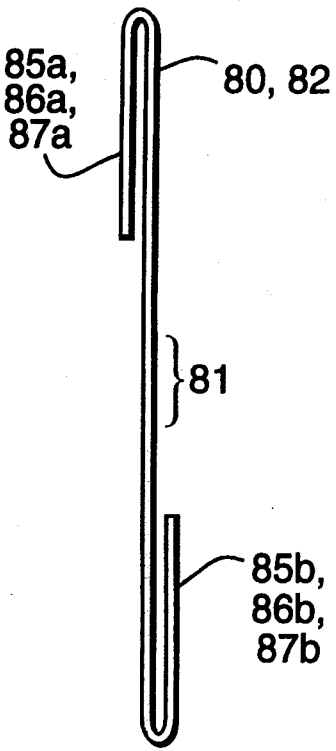
FIG. 12 is a side elevational view of the cardholder in FIG. 11.
Figure 11:
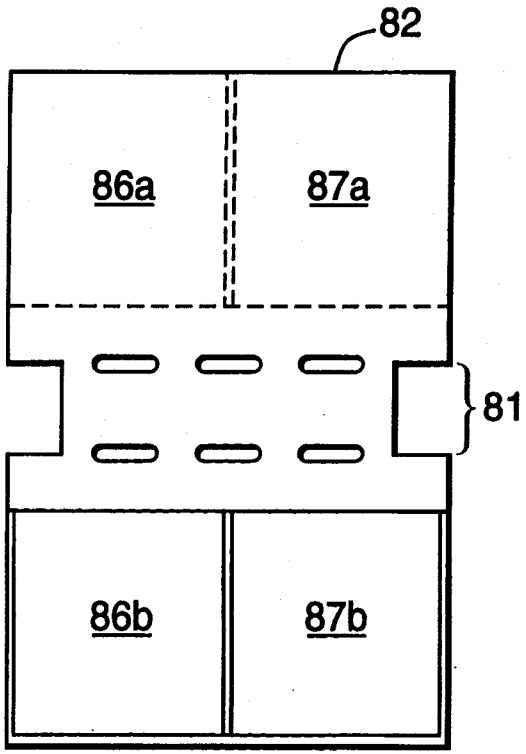
FIG. 11 is a top plan view of a further cardholder.
Figure 10:
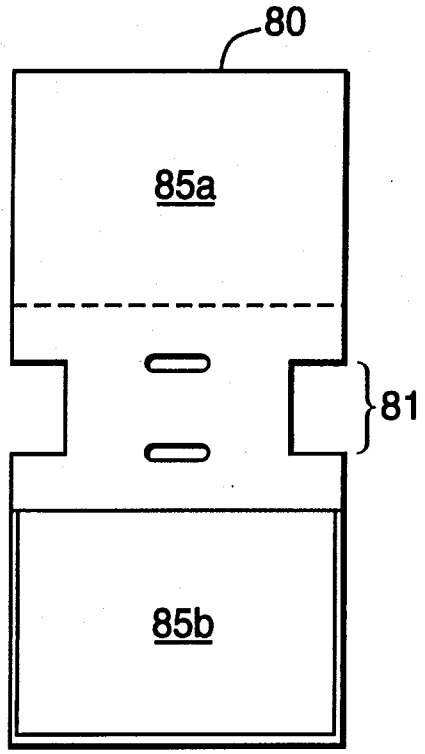
FIG. 10 is a top plan view showing an alternate cardholder.
Figure 9:
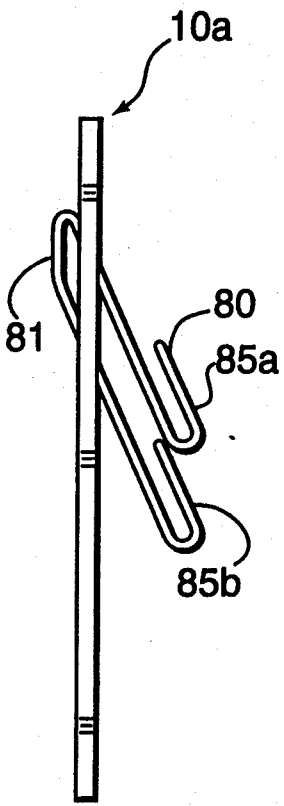
FIG. 9 is a side elevational view of a further embodiment of the flat base with card holders mounted thereon.

FIG. 9 shows base 10*a* with cardholder 80 (FIG. 10) forming two pockets 85*a* and 85*b* on one side of base 10*a*. Pocket 85*a* forms one tier with pocket 85*b* positioned slightly lower to form a second tier. A central region 81 is disposed on the second side of base 10*a*, opposite pockets 85*a* and 85*b*. FIG. 11 shows a further cardholder 82 with pockets 86*a*, 87*a*, 86*b* and 87*b*. As can be seen in FIG. 12, pockets 85*a*, 86*a* and 87*a* are disposed opposite pockets 85*b*, 86*b* and 87*b*. Accordingly, when they are mounted onto base 10*a*, as shown in FIG. 9, pockets 85*b*, 86*b* and 87*b* face upwardly. The cardholder then passes through one of the slits with central region 81 extending along the back of base 10*a* to an adjacent slot. The cardholder then passes through the adjacent slot with pockets 85*a*, 86*a* and 87*a* also facing upwardly. As can be appreciated, base 10*a* is ideally provided with an even number of slots to be used in pairs.

While only several embodiments of the present invention has been shown and described, it is to be understood that many changes and modifications may be made thereunto without departing from the spirit and scope of the invention as defined in the appended claims.

What is claimed is:

1. A device for storing and providing ready access to a plurality of items comprising:

a base member having a plurality of slits therein, each slit forming a first set of tabs and a second set of tabs; and a translucent item holder removably mounted on said base member for storing a plurality of items, said first and second set of tabs working in conjunction with each other to mount said item holder, retain said item holder in position and permit said item holder to be flipped.

2. The device according to claim 1, wherein said plurality of slits are arranged parallel to each other on said base member.

3. The device according to claim 2, wherein each slit is a continuous rectangular wave-shaped slit.

4. The device according to claim 3, wherein said first set of tabs extends in a first direction and said second set of tabs extends in a second direction.

5. The device according to claim 4, wherein said item holder has complementary slots for receiving one of said first and second sets of tabs, the other of said first and second sets of tabs having free ends and retaining said item holder in position.

6. The device according to claim 5, wherein said first set of tabs alternate with said second set of tabs.

7. The device according to claim 6, wherein said item holder includes panels located between the complementary slots for contacting said free ends.

8. The device according to claim 7, additionally comprising a plurality of translucent item holders each including a lower edge, said plurality of translucent item holders are tiered on said base member so that said lower edges are simultaneously visible.

9. The device according to claim 8, wherein said base member includes a front side and a back side, each of said plurality of translucent item holders includes at least one front pocket located on one side of the complementary slots and at least one rear pocket located on the opposite side of the slots, said pockets being symmetrical about a line parallel and intermediate the slots, wherein said at least one front pocket is located adjacent to the front side and said at least one rear pocket is located adjacent to said back side of said base member.

10. The device according to claim 9, wherein said base member has a margin with spaced holes formed therethrough for retention by ring means.

11. The device according to claim 9, wherein said base member has a margin with spaced holes formed therethrough for retention by binding means.

12. The device according to claim 8, wherein said base member includes a front side and a back side, each of said plurality of translucent item holders includes at least one front pocket located on one side of the complementary slots and a back edge located on the other side of the slots, wherein said at least one front pocket is located adjacent to said front side and said back edge is located adjacent to said back side of said base member.

13. The device according to claim 12, wherein said base member additionally includes a backing layer for covering said back side and said back edges of said plurality of translucent item holders.

14. The device according to claim 13, wherein said base member additionally includes an adhesive layer located on a side of said backing layer opposite said back side.

15. The device according to claim 14, wherein said base member additionally includes a covering layer located on a side of said adhesive layer opposite said backing layer.

16. The device according to claim 15, wherein said base member is made of a material more rigid than said item holder.

* * * * *